US006912824B2

(12) United States Patent
vonBampus

(10) Patent No.: US 6,912,824 B2
(45) Date of Patent: Jul. 5, 2005

(54) APPARATUS, COMPOSITION AND METHOD FOR FINISHING A DRYWALL INSTALLATION

(75) Inventor: Ray E. vonBampus, Sanford, FL (US)

(73) Assignee: RLM, LLC, Orlando, FL (US)

( * ) Notice: Subject to any disclaimer, the term of this patent is extended or adjusted under 35 U.S.C. 154(b) by 0 days.

(21) Appl. No.: 10/800,554

(22) Filed: Mar. 15, 2004

(65) Prior Publication Data

US 2004/0182042 A1 Sep. 23, 2004

Related U.S. Application Data

(60) Provisional application No. 60/455,107, filed on Mar. 14, 2003.

(51) Int. Cl.[7] ..... E04B 1/00; E04G 21/00; E04G 23/00

(52) U.S. Cl. ..... 52/741.13; 52/741.1; 52/741.4; 52/746.1; 52/393; 442/391; 442/392

(58) Field of Search ..... 52/741.13, 741.1, 52/746.1, 741.4, 742.1, 459, 393; 442/327, 329, 341, 361, 391, 392

(56) References Cited

U.S. PATENT DOCUMENTS 2,078,049 A * 4/1937 Benedict ..... 52/417
3,390,003 A * 6/1968 Cooper ..... 106/780
4,522,004 A * 6/1985 Evans et al. ..... 52/409
5,732,520 A * 3/1998 Maietta ..... 52/483.1
2004/0154264 A1 * 8/2004 Colbert
2004/0211139 A1 * 10/2004 Peng

* cited by examiner

*Primary Examiner*—Carl D. Friedman
*Assistant Examiner*—Nahid Amiri
(74) *Attorney, Agent, or Firm*—Allen, Dyer, Doppelt, Milbrath & Gilchrist, P.A.

(57) ABSTRACT

An apparatus and method are disclosed for finishing a drywall installation which includes providing drywall mud; providing a continuous twisted strand having a plurality of layers of nonwoven fibrous cellulosic material, wherein at least one individual layer of the plurality of layers of nonwoven fibrous cellulosic material contains an accelerant effective for accelerating setting time of the drywall joint compound; feeding the continuous strand into a cutter and cutting the continuous strand into particles motivated by air pressure so as to generate a stream of cellulosic fibers wherein at least some of the cellulosic fibers contain the accelerant; generating a stream of the drywall joint compound motivated by air pressure; and combining the stream of drywall joint compound with the stream of cellulosic fibers while applying the combined streams onto a predetermined portion of the drywall installation being finished.

4 Claims, 9 Drawing Sheets

APPARATUS, COMPOSITION AND METHOD FOR FINISHING A DRYWALL INSTALLATION

RELATED APPLICATIONS

This application claims priority from U.S. provisional application Ser. No. 60/455,107, which was filed on Mar. 14, 2003, and which is incorporated herein by reference in its entirety.

FIELD OF THE INVENTION

The present invention relates to the field of gypsum drywall and, more particularly, to an apparatus, composition and method for finishing a drywall installation.

BACKGROUND OF THE INVENTION

Gypsum drywalls, also known as wallboards, or just boards, are formed by sandwiching a core of wet gypsum plaster between two sheets of heavy paper. After the plaster core dries and sets, the sandwich becomes a rigid, very strong, and naturally fire-resistant building material. Gypsum in its natural state contains water, which releases steam when exposed to a fire's heat. Because the conversion of the water to steam consumes heat energy, heat transfer from the fire is retarded. Specific fire retardant compositions may also be added to the gypsum plaster to make drywall having yet a greater fire resistance. Gypsum drywall is an important building material throughout the world.

In building a structure, gypsum drywall is nailed to underlying supports to form the walls and other surfaces of the structure. Once nailed in place, the seams or joints between adjacent boards must be filled-in with drywall joint compound, also known in the art as "mud." Once the mud is applied to the joint, the joint must be covered with a strip of heavy paper, which is then overcoated with additional mud in order to smooth out the appearance of the wall. Conventionally finished joints do not provide the same degree of fire retardancy as the drywall itself. Thus, in a structure fire the joints will pop their seams before the drywall itself is affected by the heat.

Accordingly, finishing the drywall installation is a time-consuming, manual process which delays the completion of the structure, as paint cannot be applied to the walls until after the drywall joints are filled, and they dry and set. Additionally, there occurs much waste of mud during the finishing process.

SUMMARY OF THE INVENTION

With the foregoing in mind, the present invention advantageously provides an apparatus and method for finishing drywall installations. An apparatus and method according to the invention may be summarized as follows.

The present invention includes a process for finishing drywall and utilizing Gypsum or similar materials in conjunction with an air-driven spray gun having an associated cutter device. The spray gun combines drywall mud or other similar mixture with a cellulose fiber strand impregnated with a powdered activator or accelerant. The present spray gun distributes the mixture onto any drywall, and may be employed in filling empty space between existing drywall installations for fireproofing or insulation purposes.

Equipment Contained in the Present System

Conventional trailer-mounted texture rig or portable rig, as known in the art. The material hoppers, air compressor, hydraulic pump, trailer, mounted fluid drive pumps; fluid and air lines are all of the trailer mounted or portable type. Strand gun with shoulder mount.

Backpack which holds a box of strand and supports the spray gun unit; with shoulder straps.

Strand is preferably packaged in 250 yd. and 500 yd spool boxes, as further described below.

Wall tools are standard drywall finishing tools, such as a float knife, corner knife, etc.

The process may be summarized as follows.

Preparation Step 1

Load #1 material hopper with joint compound

Load #2 material hopper with texture

Preparation Step 2

Install spool of TexStream Strand onto back pack and then thread strand into drive rollers.

Application of Mud

1. Start trailer or portable engine & compressor.
2. Engage stirrers on hoppers.
3. Open valves on gun unit to fill hoses with material.
4. Test gun function in trash container before using on walls.
5. Adjust gun if required.
6. Spray seams between drywall boards with just enough material to fill the crack.
7. Follow up spray pattern with the proper finishing tool. Keep the tool clean to prevent the tool from sticking to the spray mix. Tool the seams only enough to flatten the spray build and to push the spray mix into the seam. Tool off any globs on high spots. Follow the same procedure with inside and outside corners using inside and outside corner knives.
8. After completing the seam filling procedure return to the starting point.
9. At this time, the setting on the spray gun unit may be changed to spray wall texture material. Proceed to spray one even coat of texture material on ceilings and walls as desired.

Because of the strand composition, further described below, all joints and seams sprayed four hours prior or more will have started to cure. This will enable the application of wall and ceiling spray to be applied usually within one workday. FIG. 8 shows an overall schematic view of a preferred embodiment of the described invention, including an alternate embodiment of the spray gun.

The Strand Gun is a hybrid design based on a modified Binks gun, or more preferably the high viscosity spray gun as shown in FIGS. 1 and 2. Starting with a Binks or TSI base unit spray gun, TexStream adds a special air control after the valve. Attached to the special air chamber is a custom-machined spray tip that enables the sprayed joint compound or texture to exit the nozzle at the proper volume. The nozzle spray tip orifice is appropriately sized for the spray pattern desired. All components are preferably made of nonferrous metals such as aluminum, stainless, brass, etc.

The gun body and handle are shown in FIG. 1. The gun housing has inlets to support two fluid lines or hoses, one for air under pressure, and one for mud. As shown in the diagram of FIG. 8, the system may accommodate up to two other materials mixed with the mud. For example, a texture material, and paint. The gun housing may include a mount installed for connecting the cutter housing thereto. A metering valve may be mounted between the fluid hose and the inlet on the gun housing to control working pressure, and to turn the flow of material on and off. The gun housing also includes fluid and air chambers to dispense fluid and air and an exit nozzle at the front of the gun.

The strand cutter, as shown in FIGS. 2–5, includes an air driven motor. Mounted on the top of the gun body is an air driven strand cutter device to specifically process the strand into the proper cellulose form. The strand cutter is a custom design. This unit is a low RPM, high torque, unit consisting of a strand inlet, preferably a rubber compound drive feed roller and a metal drive feed roller. The cutter wheel is mounted in a processing chamber specifically engineered to process the strand material for mixing with joint compound. The motor speed is controlled by the air pressure setting valve mounted on the gun housing. Speed of rotation of the feed roller(s), however, is controlled by one or more gears coupled to the air motor and which rotate the feed roller(s) at lower RPM than the cutter wheel.

An optional spray cone is preferably made of a plastic or metal material and mounts on the gun downstream from the strand cutter. The aids in joining the mud stream and the stream of fibrous cellulosic particles cone produces a vortex to help mix and direct the cutter strand stream and the liquid material stream, enabling the gun operator to aim and direct cutter output material of gun.

The materials include spray texture. For example, Sheetrock® wall and ceiling texture or similar brand and mix. The texture spray is a standard base wall spray product produced by United States Gypsum Corp. or a similar product already widely used in the industry, preferably having a water base.

The seam fill is lightweight or standard joint compound, also known as "mud." The seam filler is a standard joint compound produced by United States Gypsum Corp. or a similar brand already used as a standard in joint filler procedures in the building industry. The joint compound or mud enters the present spray gun though a high pressure hose. It then travels through a machined control valve then into the gun body. Next, it travels through a gun chamber which leads to the mixing chamber then to the spray nozzle.

Spray texture which is mixed with water to the proper consistency, enters the gun through a high pressure hose. It then travels through a machined control valve, then into the gun body and though a gun chamber which leads to the mixing chamber, then to the spray nozzle.

The strand, most preferably in spool form, is boxed in a continuous feed from a backpack device worn by the operator and fed through a supply tube over the operator's shoulder and into the back side of the cutter housing of the spray gun. As the strand enters the cutter housing, it travels through a guide orifice that keeps the strand centered in the drive rollers. The drive rollers grab the strand and push it through the cutting rollers which chop the strand into small particles that are blown into the spray exit cone.

Industry standards require drywall seam tape to be used in the initial application of filling seams in drywall in conjunction with joint compound. The strand of the present invention comprises a cellulose base flat-folded and twisted strand. It is not dissimilar in paper composition from the industry standard drywall seam tape made by U.S.G. or other manufacturers for filling voids or seams in drywall. The presently disclosed strand, however, is preferably a folded and twisted strand specifically designed to feed through the spray gun disclosed herein. The present strand contains an accelerant, also known as an activator, or quick dry powder compound already used in the building industry for drywall finishing but never before applied as disclosed in the invention. The powder speeds the drywall joint cure time and prevents shrinkage. The accelerant is dry powdered hydrous calcium sulfate, also known as gypsum, or similarly effective material.

At the spray cone exit area, air compressed through the spray tip, fluid produced through the spray nozzle, and cut strand particles produced through the spray cone, are all combined under high pressure to form a spray pattern for the application of the drywall finish product or drywall seam filler product, which can be changed by adjusting or turning on and off valves to fluid and air supplies to create a variety of seam fills or drywall texture applications, and is unique to the industry.

Cellulose fiber acceleration occurs because the strand contains sufficient hydrous calcium sulfate and gypsum, to impart to the mud a quick dry time when sprayed and mixed in the spray cone/spray fan area. The gypsum compounds may also be mixed with other material compounds or fillers such as mica, which is a structural filler and is also used as a dry lubricant to aid in the mixing and manufacturing process. The bulk or majority of the accelerant, which is an off-white colored powder, is applied to at least one of the layers or is deposited between the layers of the fiber which make up the strand. This process is effected before the material is wadded, or folded, and twisted into a cellulose body. The strand is manufactured in large bulk rolls so as to create a continuous feed spool which is packaged in a box for the end user. The boxes are sized to fit into a backpack worn by the technician using the spray gun. The strand is manufactured specifically for application in the presently disclosed spray gun and cutter. The cutter processes the strand into cellulose cross-linked fiber which is then mixed with the joint compound during final application onto the drywall. This cross-linked, fiber rich, joint compound creates a drywall joint that is as strong or stronger than a conventional drywall joint. The accelerant allows the drywall contractor to finish the job quickly without waiting for bed coat joints to dry overnight, or longer, depending on weather conditions.

Typically, this strand or cord type material is a cellulose fiber woven or twisted into a cord or wrap and is then formed into a continuous feed roll approximately ¼ to 1¼ in. diameter, depending on the job requirement, and is packaged into 250 yd. and 500 yd. boxes.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art.

Figure 9:
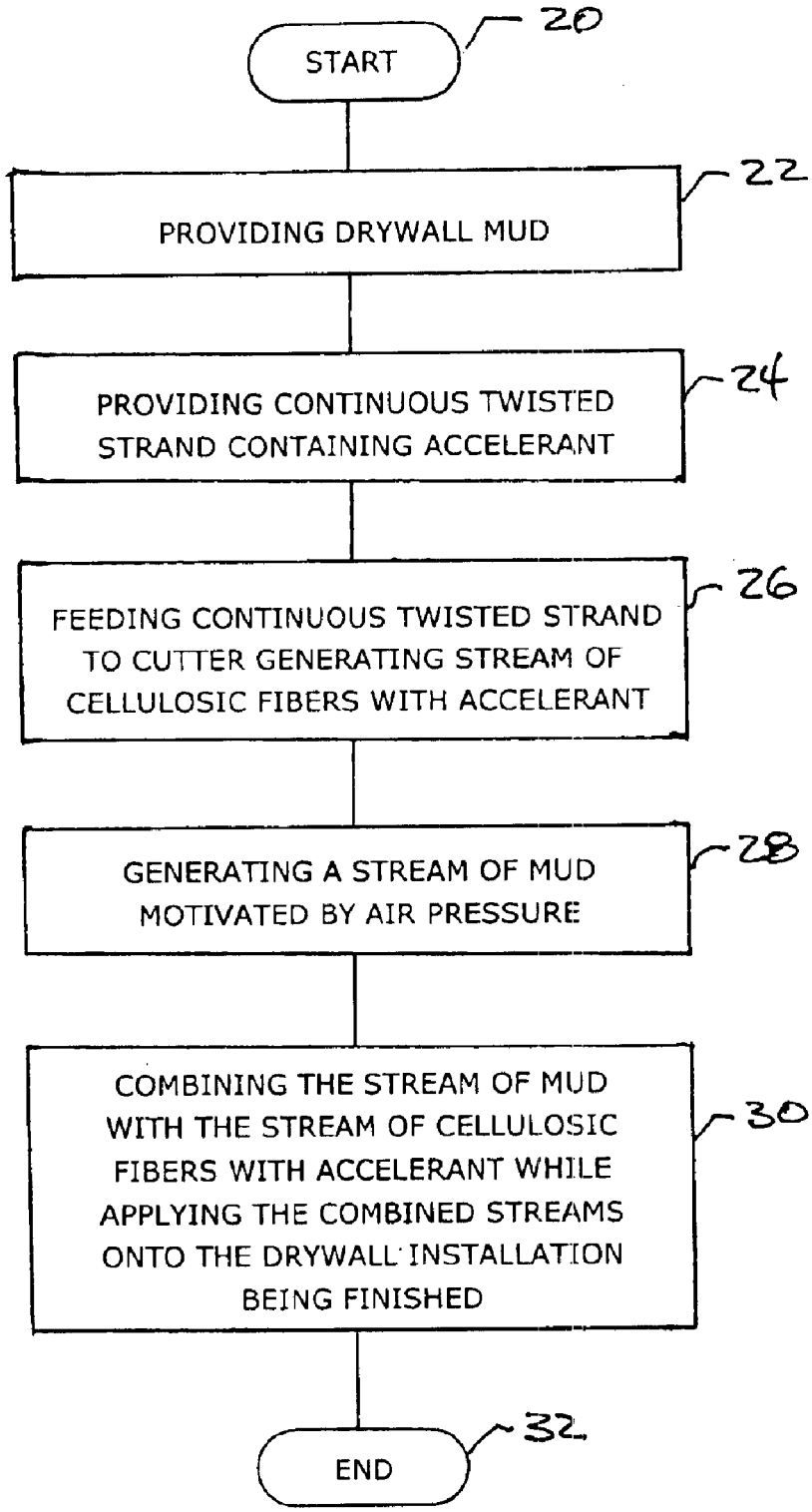
FIG. 9 is a block diagram illustrating the method of the invention.

A method aspect of the invention, illustrated in FIG. 9, starts 20 by first providing drywall joint compound, also known in the industry as "mud" 22. Then the method calls for providing a continuous strand 24 having a plurality of layers of nonwoven fibrous cellulosic material, wherein at least one individual layer of the plurality of layers of nonwoven fibrous cellulosic material contains an accelerant effective for accelerating setting time of the drywall joint compound, and wherein the plurality of layers of nonwoven fibrous cellulosic material are at least twisted so as to form the continuous strand. The method continues as the continuous strand is fed 26 into a cutter and the continuous strand is cut into sufficiently small particles motivated by air pressure so as to generate a stream of cellulosic fibers wherein at least some of the cellulosic fibers contain the accelerant. The method further includes generating a stream 28 of the drywall mud compound motivated by air pressure and combining 30 the stream of drywall joint compound with the stream of cellulosic fibers while applying the combined streams onto a predetermined portion of the drywall installation being finished. Thereafter the method ends 32.

The method also includes wherein the accelerant comprises dry powdered hydrous calcium sulfate. Additionally, in the method finishing may comprise filling spaces between adjacent dry wall panels with the combined streams of drywall joint compound and cellulosic fibers. Further, in the method of the invention, the continuous strand may further include an effective fire retardant material.

Figure 8:
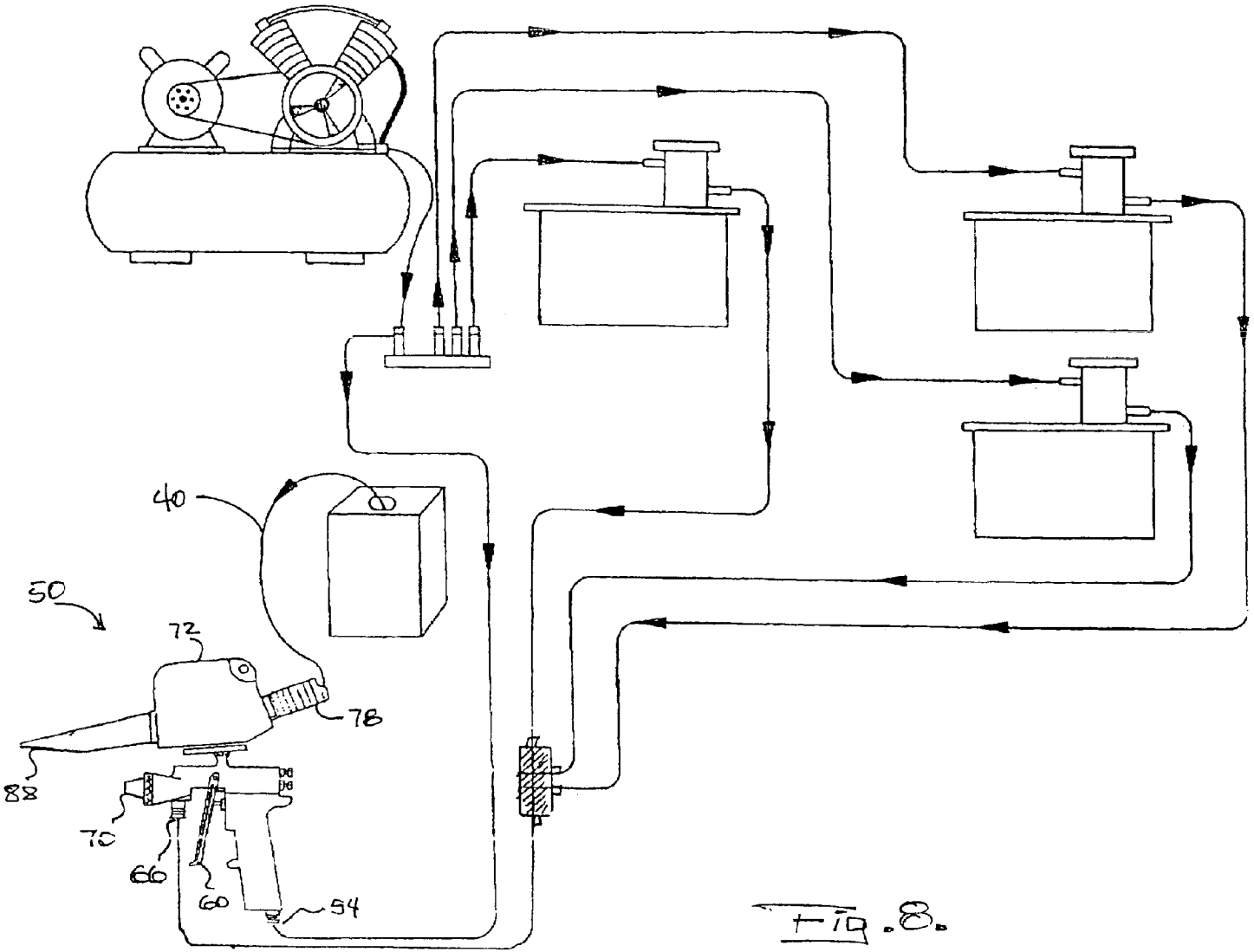
FIG. 8 is an overall schematic diagram of the apparatus of the invention.

The invention also includes a continuous strand 40 of fibrous cellulosic material for combining with drywall joint compound, shown in the system diagram of FIG. 8. The strand 40 comprises a plurality of layers of nonwoven fibrous cellulosic material having a width dimension and a length dimension, and an accelerant carried by at least one individual layer of the plurality of layers of nonwoven fibrous cellulosic material, wherein the accelerant effectively promotes setting of the drywall joint compound.

The continuous strand of fibrous cellulosic material also is preferably cut into small pieces or particles before combining with drywall joint compound. In the strand disclosed the plurality of layers of nonwoven fibrous cellulosic material comprises relatively thin individual layers of nonwoven fibrous cellulosic material and may be twisted so as to form the continuous strand. Most preferably, the plurality of layers of nonwoven fibrous cellulosic material are folded and twisted so as to form the continuous strand. Additionally, the continuous strand of fibrous cellulosic material contains an accelerant which comprises dry powdered hydrous calcium sulfate. The accelerant may further comprise an inert filler such as mica or dolomite and similar others known in the art, or combinations thereof.

The apparatus of the invention, shown in FIGS. 1–8, includes an air pressure operated spray gun 50 for drywall mud. The spray gun 50, best shown in FIGS. 1–2, comprises a gun housing 52 having a gun air inlet 54 for therethrough receiving air under pressure. The gun air inlet 54 is fluidly connected to a main air chamber 56, and a main flow control valve 58 actuated by a trigger 60 and positioned in the main air chamber so as to control passage of air from the main air chamber to a mud mixing chamber 62, to a cutter air chamber 64, or to a combination thereof. A mud inlet 66 is positioned for receiving a flow of drywall mud and is fluidly connected to the mud mixing chamber 62. A mud valve 68 responsive to air pressure is positioned in the gun housing 52 to control mud flow from the mud mixing chamber 62 to a mud discharge nozzle 70 fluidly connected for therethrough discharging a stream of mud spray responsive to the air pressure.

Figure 1:
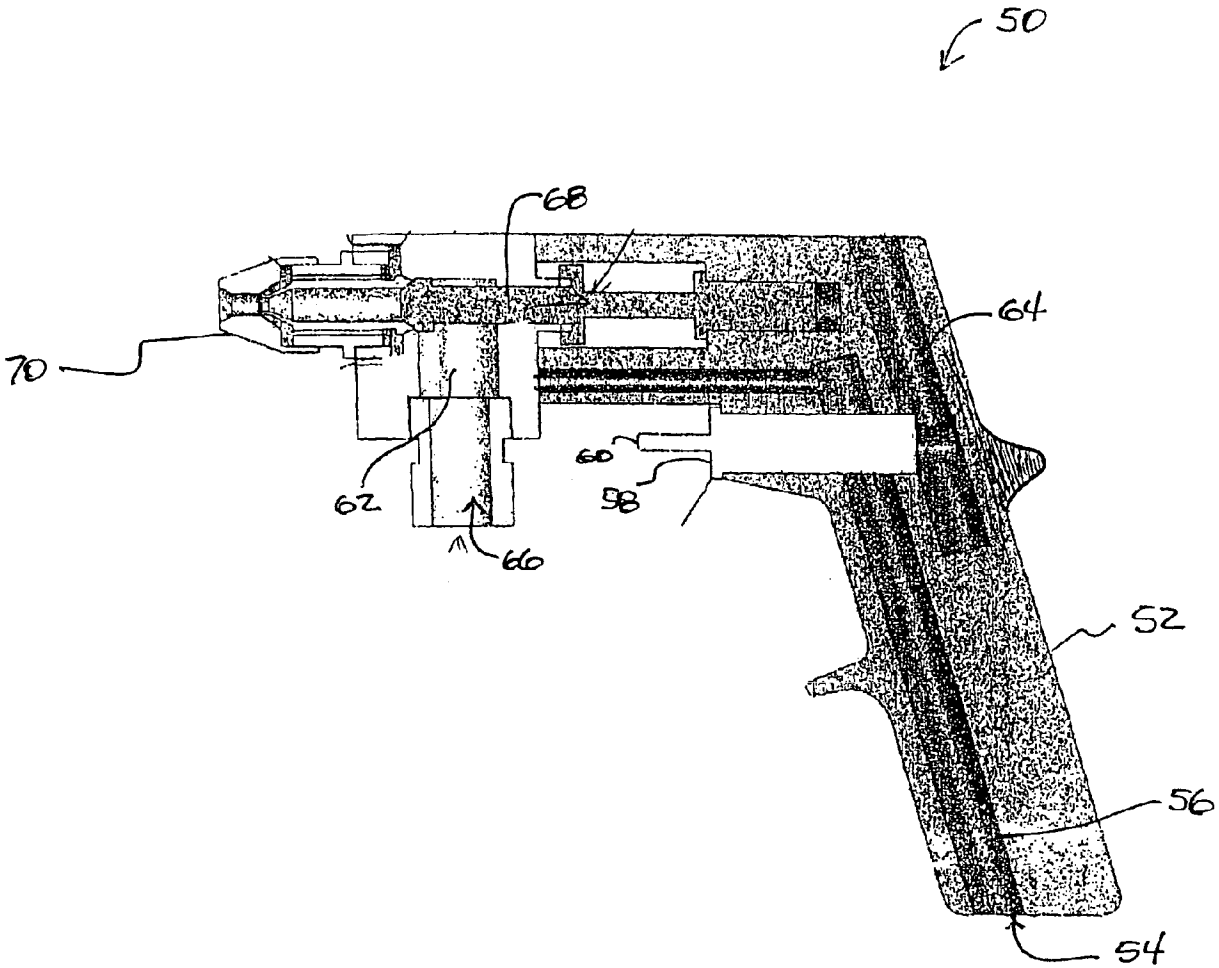
FIG. 1 is a cross sectional side elevation of the gun housing according to an embodiment of the present invention.
Figure 2:
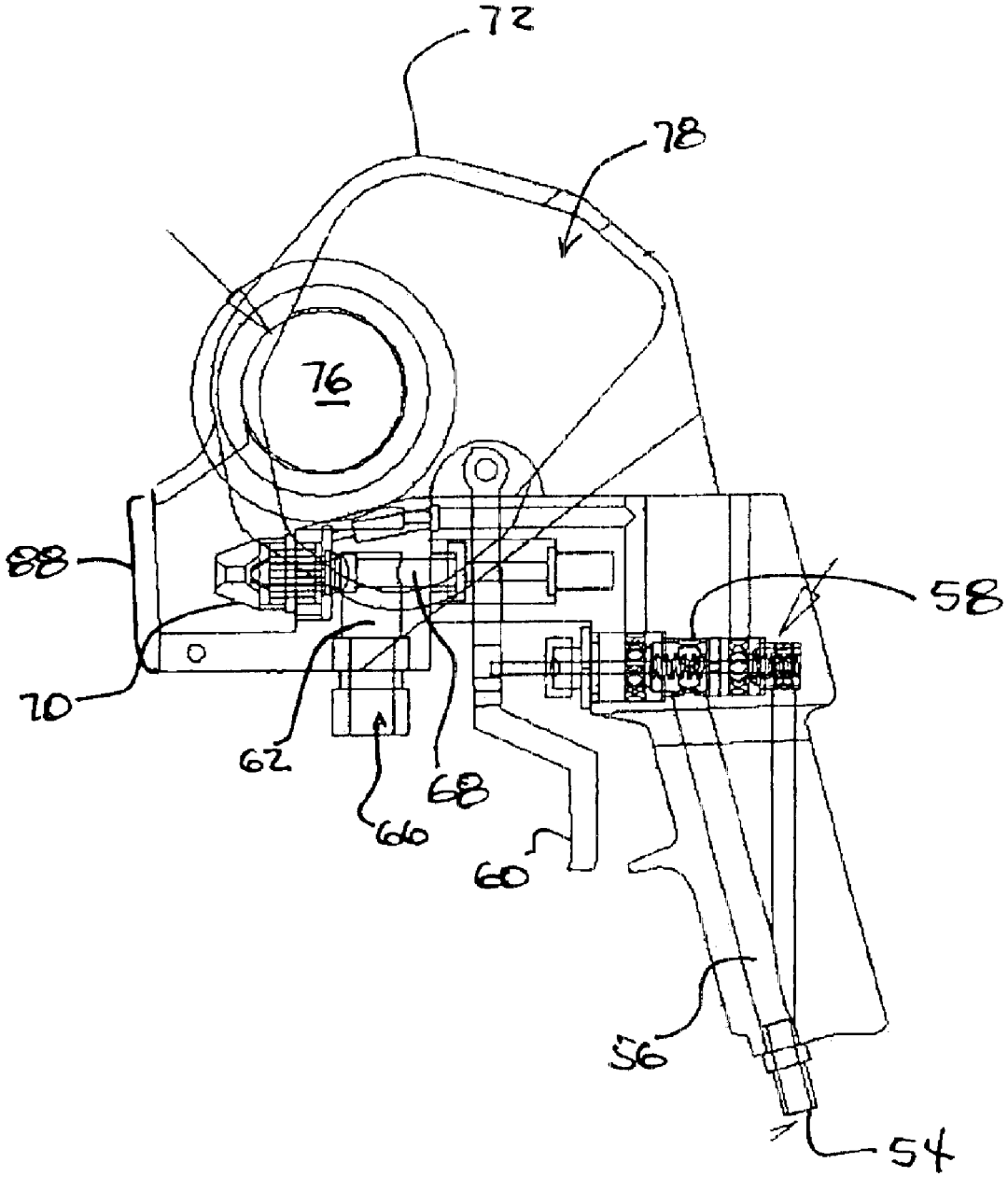
FIG. 2 is a side elevation schematic diagram of the spray gun, including the gun housing and the cutter housing.
Figure 3:
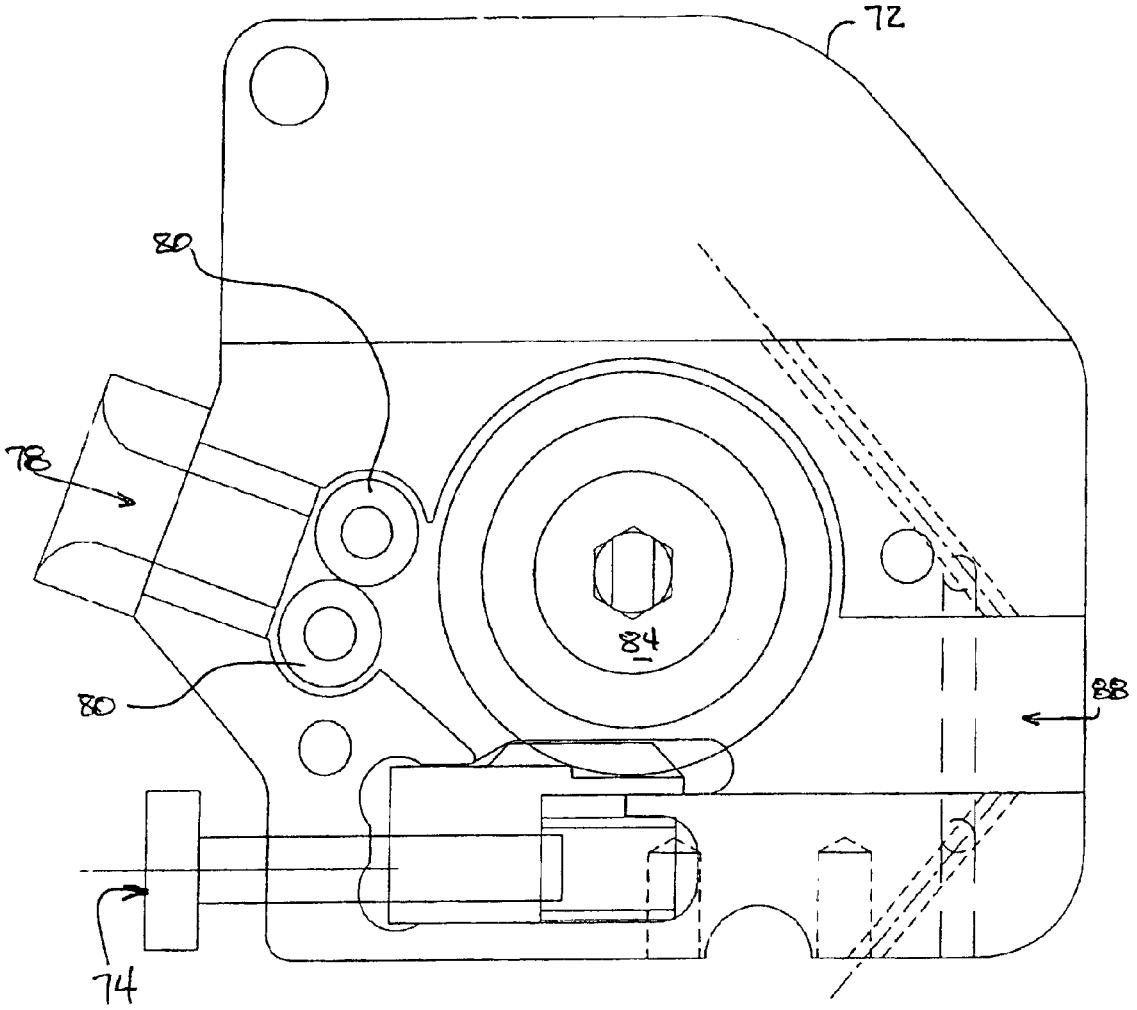
FIG. 3 shows the cutter housing and internal components of the cutter in a cross section side elevation.
Figure 4:
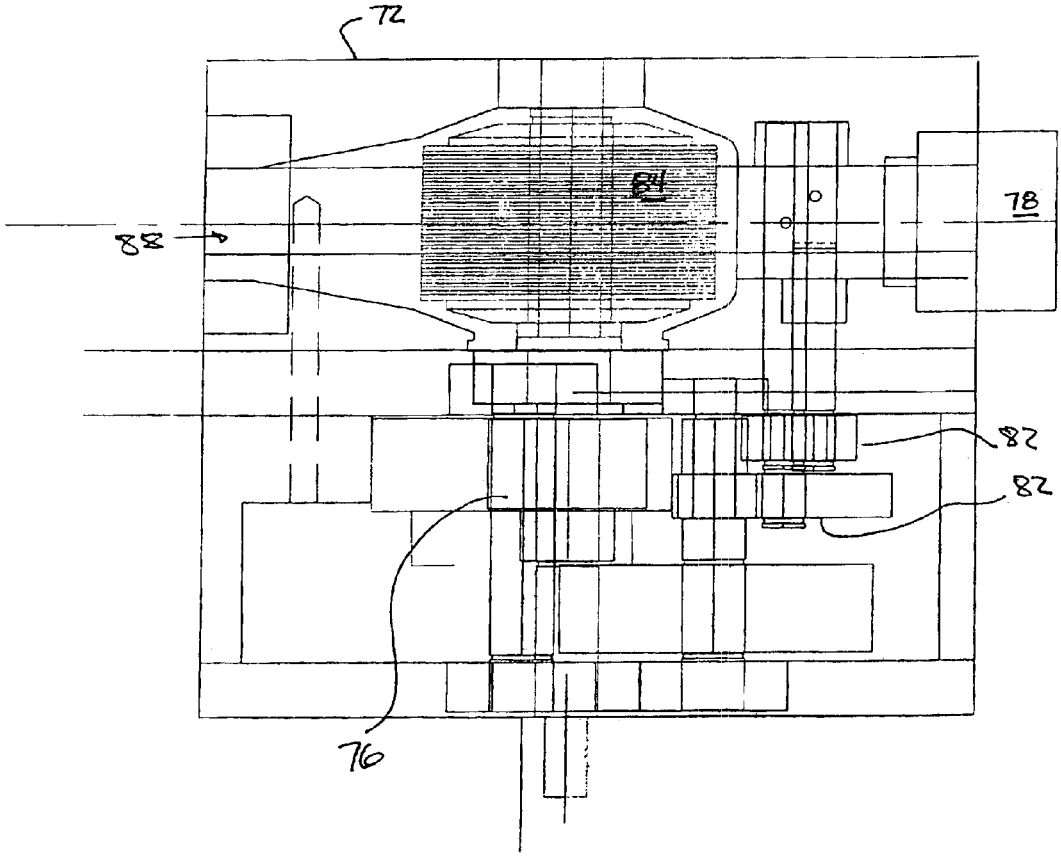
FIG. 4 is a top plan view of the cutter of FIG. 3.
Figure 5:
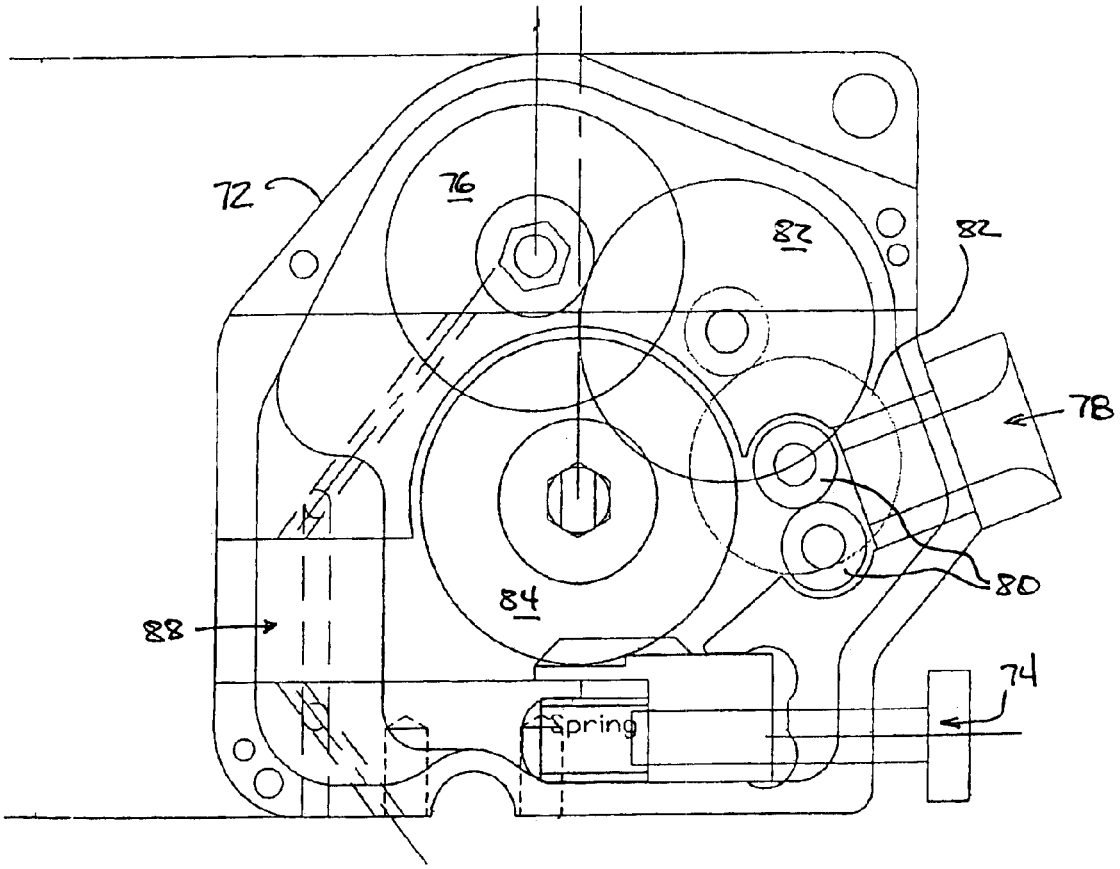
FIG. 5 is an opposite side elevation cross section of FIG. 3.
Figure 6:
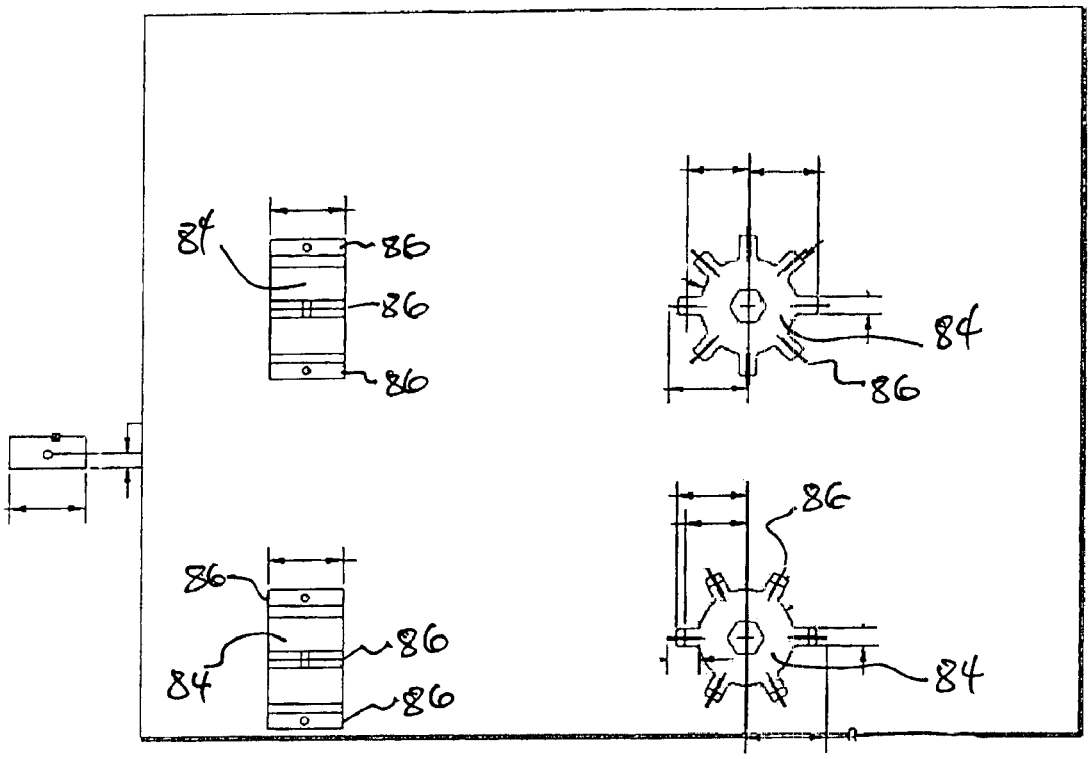
FIG. 6 illustrates front elevation views and side elevation views of two embodiments of the cutter wheel of the present invention.
Figure 7:
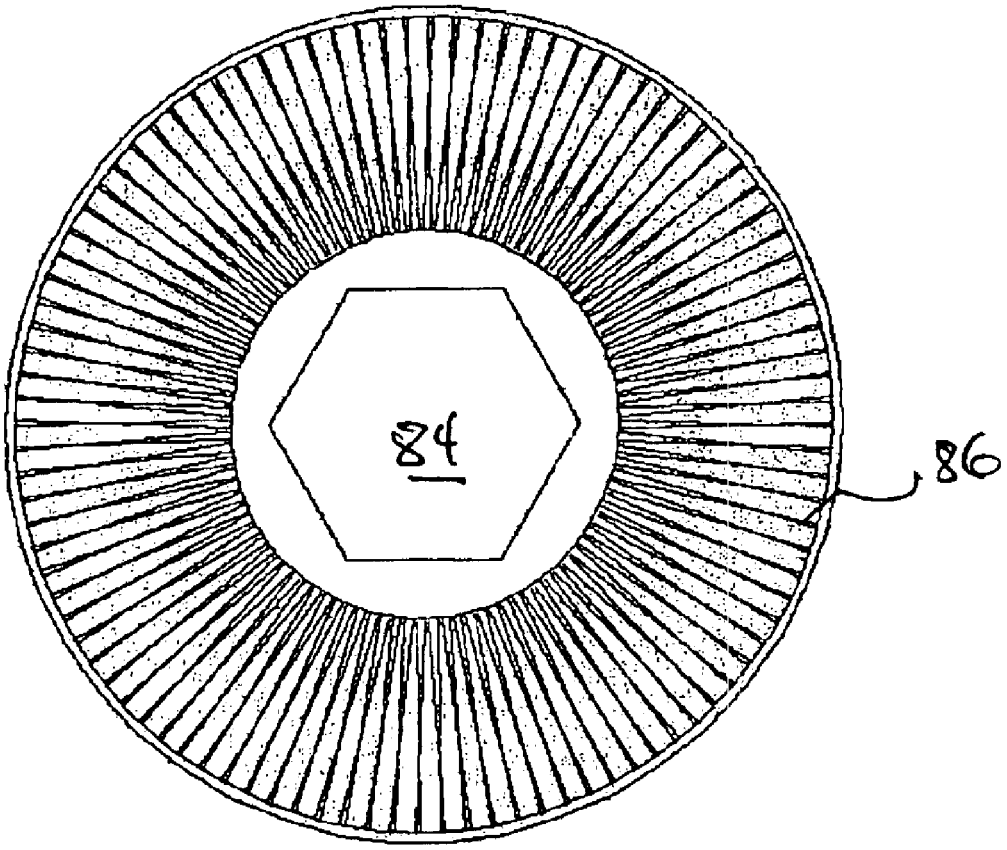
FIG. 7 shows a side elevation view of a cutter wheel comprising wires for cutting.

The spray gun 50 also includes a cutter housing 72, shown in FIGS. 3–5, positioned on the gun housing 52 and including a cutter air inlet 74 fluidly connected to the cutter air chamber 64 in the gun housing 52. An air motor 76 is fluidly connected to the cutter air inlet 74 and is responsive to air pressure received through the cutter air inlet. A cutter feed inlet 78 is positioned for receiving a continuous strand 40 of fibrous cellulosic material into the cutter housing 72. At least one feed roller 80 is positioned adjacent the cutter feed inlet 78 and is operatively coupled to the air motor 76 by one or more feed roller drive gears 82 for feeding the continuous strand 40 of fibrous cellulosic material to a cutter wheel 84 having a plurality of cutting blades 86 thereon. The cutter wheel 84, various embodiments of which are shown in FIGS. 6–7, is operatively coupled to the air motor 76 and positioned adjacent the at least one feed roller 80 so as to receive and cut the fed continuous strand 40 into small particles. Cutter wheel 84 may be disposed with a number of blades appropriate for cutting strand 40 to particles of a desired size range, as illustrated in FIG. 6. A cutter wheel 84 having cutting wires as blades is shown in FIG. 7. The one or more feed roller drive gears 82 provide reduction in RPM generated by the air motor 76 so that the at least one feed roller 80 rotates at lower RPM than the cutter wheel 84. A cutter discharge outlet 88 is adjacent the cutter wheel 84 and downstream therefrom so as to therethrough discharge the small particles of cut strand responsive to air pressure in a stream of fibrous cellulosic particles. The cutter discharge outlet 88 is positioned relative to the gun housing 52 so as to therein enclose the mud discharge nozzle 70 so that both discharges exit through a single opening, as shown in FIG. 2, to mix the stream of mud spray with the stream of fibrous cellulosic particles into a combined discharge stream of mud spray containing fibrous cellulosic particles. An alternative but less preferred embodiment, shown in FIG. 8, includes a cutter discharge outlet 88 separate from the mud discharge nozzle 70 so that the discharge streams mix in mid-air.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. A method of finishing a gypsum drywall installation, the method comprising:

providing drywall joint compound;

providing a continuous strand having a plurality of layers of nonwoven fibrous cellulosic material, wherein at least one individual layer of said plurality of layers of nonwoven fibrous cellulosic material contains an accelerant effective for accelerating the setting time of the drywall joint compound, and wherein said plurality of layers of nonwoven fibrous cellulosic material are at least twisted so as to form said continuous strand;

feeding said continuous strand into a cutter and cutting said continuous strand into sufficiently small pieces motivated by air pressure so as to generate a stream of cellulosic fibers wherein at least some of said cellulosic fibers contain the accelerant;

generating a stream of said drywall joint compound motivated by air pressure; and combining the stream of drywall joint compound with the stream of cellulosic fibers while applying the combined streams onto a predetermined portion of the drywall installation being finished.

2. The method of claim 1, wherein the accelerant comprises dry powdered hydrous calcium sulfate.

3. The method of claim 1, wherein finishing comprises filling spaces between adjacent dry wall panels with the combined streams of drywall joint compound and cellulosic fibers.

4. The method of claim 1, wherein the continuous strand further comprises an effective fire retardant material.

* * * * *